United States Patent [19]

Marshall

[11] Patent Number: 5,054,415

[45] Date of Patent: Oct. 8, 1991

[54] MOORING/SUPPORT SYSTEM FOR MARINE STRUCTURES

[75] Inventor: John J. Marshall, Newcastle-Upon Tyne, United Kingdom

[73] Assignee: Marshall Industries Limited, Channel Islands

[21] Appl. No.: 435,389

[22] PCT Filed: Mar. 10, 1988

[86] PCT No.: PCT/GB88/00182

§ 371 Date: Nov. 6, 1988

§ 102(e) Date: Nov. 6, 1988

[87] PCT Pub. No.: WO88/06999

PCT Pub. Date: Sep. 22, 1988

[30] Foreign Application Priority Data

Mar. 11, 1987 [GB] United Kingdom ..... 8705767
May 15, 1987 [GB] United Kingdom ..... 8711544

[51] Int. Cl.[5] ..... B63B 21/50
[52] U.S. Cl. ..... 114/293; 114/230
[58] Field of Search ..... 114/230, 293; 166/354; 405/224

[56] References Cited

U.S. PATENT DOCUMENTS 2,986,888 6/1961 Borrmann et al. ..... 114/293

FOREIGN PATENT DOCUMENTS 17291 2/1979 Japan ..... 114/293
1595045 8/1981 United Kingdom ..... 114/293

*Primary Examiner*—Sherman Basinger
*Assistant Examiner*—Thomas J. Brahan
*Attorney, Agent, or Firm*—Osterlenk, Faber, Gerb & Soffen

[57] ABSTRACT

A mooring/support system for anchoring marine structure comprises a plurality of anchor elements equiangularly spaced and connected to the sea bed at one end by means of anchors. The other ends of the anchor elements are connected to a common bridle element. Eight anchor elements may be used giving the system a octagonal configuration. Each anchor element comprises a buoyant portion and a non-buoyant portion, the buoyant portion being such that a mooring point positioned below the surface of the water to provide an essentially horizontal restraint to the moored or supported object and to allow ships to pass over the system without contact therewith. The system is such that it can be pre-installed before arrival of the marine structure. The buoyancy of the chambers may be varied so as to regulate the preload of the system.

7 Claims, 13 Drawing Sheets

PLAN OF MOORING/SUPPORT SYSTEM

MOORING/SUPPORT SYSTEM FOR MARINE STRUCTURES

BACKGROUND OF THE INVENTION

This invention relates to a mooring/support system for marine structures. In this specification marine structures include submerged structures or structures which float or are supported above or near the surface from the sea bed, and include both mono-hull and semi-submersible type ships, barges, oil or gas drilling and production platforms and vessels, towers, fish nets, pens, or devices which may support communications and radar equipment, navigational aids, or any equipment needed to be positioned at sea. Reference herein to a ship or vessel is accordingly to be taken as meaning any marine structure.

The oil and gas industry in particular have a need for positioning operational ships in a specific location relative to the sea bed so that operations such as drilling for oil or gas, recovering and processing the oil or gas, mining and exploring the ocean or its sub-surface can be achieved. The ships or platforms would hold all the equipment necessary for completing such operations. In addition they would hold the equipment needed for communications and radar operations navigational aids, etc.

When such shipping is used in the production of oil or gas for example, it is essential to control the location of the ship during all environmental conditions within strict tolerances which are required by the characteristics of the connection for the flow of oil and gas between the ship and the sea bed. The limitation may be because of mechanical or operational restrictions.

It is known to anchor a mono-hull or semi-submersible ship using single or multiple conventional chain link or wire cable anchor lines extending downwardly from the ship in one or several directions, the anchor lines being connected to anchors in the sea bed. A riser system, which may be flexible, semi-rigid or rigid, is used for connecting the operational equipment onboard ship to sea bed equipment such as the wellhead of a subsea oil well for example. Turret mooring is provided on a mono-hull type ship to receive the mooring chains and risers while allowing the ship to rotate about the anchorage to take into account tides, winds, currents, etc, without twisting the anchor lines and risers. Uni-directional shaped ships, such as semi-submersibles, can be moored in a fixed orientation because the environmental forces act the same in all directions on the vessel; therefore these types of ships do not need a turret.

Another known marine structure used in the oil and gas industries is the tension leg platform (TLP) which is a semi-submersible type vessel that has post-tensioned anchoring tendons extending substantially vertically from the bottom of the hull to anchor points in the sea bed. This type of platform relies on considerable lateral movement to develop the horizontal restraining force it needs to stay near location. The magnitude of this movement depends on sea depth and weather conditions.

With guyed tower type structures which extend downwardly and engage with the sea bed, lateral support for the top of the tower is provided by flexible guy lines which are fixed to the upper portion of the tower and which are inclined and extend downwardly to the sea bed anchors. There can be several levels of guys.

Self supporting structures are founded on the sea bed, supporting operational platforms above the sea thereon with a structure which diverges outwards and engages with the sea bed. The structure is made of steel or concrete or a combination of both to provide the necessary strength and rigidity. Normally these platforms support the drilling or process equipment above the sea and extend down to the sea floor. The risers, and other connections to the wells are usually contained in the support structure.

In yet another known system in which the ship is dynamically positioned, the ship remains on station during all weather conditions utilizing a position monitoring device which determines the ship's exact location. The monitoring device is connected to a computer controlled propulsion system which repositions the ship when the control system senses movement away from the designated point. The system must have the capabilities to maintain the ship in position during all weather conditions. Consequently, not only are costs high for operation, maintenance, and propulsive power but also the initial investment is large. Furthermore, positive location maintenance is not attained because there is no physical restraining device connecting the ship to the sea bed. Neither can positive system reliability be absolutely assured if a critical component fails.

When a ship is positioned or supported by conventional anchorings or guys, the lateral stabilization or horizontal restoring force is provided by the horizontal component of the tension force in the anchor line. However, because of the inclination of the anchor lines an additional vertical downward force is imposed upon the ship. To counter the effects of these adverse vertical forces additional buoyancy may need to be provided in the case of floating structures while with supported towers additional strength and stiffness may need to be provided to accommodate the extra vertical load.

Additionally, forces are produced from external sources such as waves, wind, and current that also act upon the anchor lines imparting additional loadings on them. Although these loadings are usually normal to the direction of the main axis of the elements of the anchor lines they introduce amplified axial tension forces into those inclined lines which have horizontal and vertical components which introduce secondary forces on the ship or structure. Any detrimental effect caused by these secondary forces must be accounted for and this leads to additional cost and complexity.

A conventionally anchored mono-hull or semi-submersible ship requires specific equipment and facilities for the handling and storing of the anchor lines. When the water depth increases, a greater amount of anchor line is required and not only must the space necessary to store such anchor lines be provided in the ship, but also the equipment must be made larger and sturdy enough to be able to handle the movement of such large lengths of anchor lines, thus increasing the complexity of the facility. Increased water depth for both conventionally anchored ships and guyed towers tends to increase the flexibility of the entire system and this too has detrimental effects or limitations on the practicability of means of positioning the vessel within the required tolerance. In some cases performance can be improved by the addition of servo-controlled tensioning equipment, but this too increases complexity and reduces reliability.

In the case of tension leg platforms (TLP) it is necessary to introduce exceptionally high downward pretension forces which complicates anchoring by having to cater for the higher uplift on the sea bed foundations. The TLP's horizontal restoring forces are only induced by the inclination of the anchoring tendons which requires movement of the floating vessel or platform to resist external forces such as waves, winds, currents etc. This contradicts the purpose of the anchorage which is to reduce or eliminate movement.

Self supporting structures founded on the sea bed become increasingly complex and expensive as water depth becomes greater. This type of structure is not technically feasible or cost effective for conducting exploration and production activities in deeper ocean in areas of limited life and economic return.

It is an objective of the present invention to provide a mooring/support system which is simple in construction, but which is capable of accurately maintaining a ship on location with maximum reliability and safety. It is also an object of this invention, by providing a separate mooring or support, to minimize the cost and complexity of the moored or supported object, thus reducing total costs.

It is a further object of the present invention to provide a mooring/support system which can be pre-installed. That is to say, one which can be positioned, and can remain, on site independently of the marine structure as well as one that can be utilized by other vessels during other phases of a project.

BRIEF DESCRIPTION OF THE INVENTION

According to the present invention there is provided a mooring/support system for anchoring marine structures, comprising a plurality of anchor elements, each for connection to the sea bed at one end thereof, each anchor element including a buoyant portion adapted for floating above the level of the sea bed, the end of each anchor element remote from the sea bed being associated with a mooring point, wherein the remote ends of the anchor elements can be linked together by means of a common bridle element for pre-loading the mooring-/support system, thereby enabling the mooring/support system to be positioned independently of the marine structure, and the mooring points provide sites for the attachment of mooring lines of the marine structure.

Embodiments of the invention are particularly advantageous in that they can be installed before arrival of the marine structure. Use of the bridle element enables the mooring points to remain below the sea surface thereby allowing unrestricted access of attending vessels to areas within the mooring points. In addition, the mooring system of the present invention has an inherent pre-load characteristic which provides a stiffer anchorage. The system can be "tuned" by provision of an appropriate pre-load force so that the system has optimal dynamic characteristics which are appropriate for the marine structure to be moored or supported.

Also, in embodiments of the invention, the pre-load, induced into the system by virtue of the bridle element, can be utilized to control the horizontal displacement of the moored or supported structure.

The bridle element, the non-buoyant portion and other components may be formed from, inter alia, one or more cables, slender rods, pipes or wire rope.

The buoyant portion of each anchor element preferably comprises a structurally adequate chain of metal or plastics material having a plurality of interconnected links to which is attached a plurality of spaced hollow steel chambers or floats filled with low density material to provide the necessary buoyancy. The anchor element may be a wire cable, or other tension element, to a portion of which hollow steel chambers are connected.

In another alternative form, the buoyant portion of the anchor element may comprise a plurality of elongate hollow steel or low density filled elements interconnected so as to form a semi-flexible buoyant portion at the upper end of the anchor element.

In yet a further form the buoyant portion may comprise a cable which passes centrally through a series of buoyancy units which are either hollow or of low density material so that the necessary buoyancy, strength and flexibility are provided. The tension element may be threaded through a hole in the buoyancy unit.

The tension element of the anchor element may consist of a flexible or semi-flexible component(s) configured to resist tensile but not compressive forces. Suitable components include thin rods or bars, singly or in combination, thin pipes, cables, chains, wire ropes and the like.

Conveniently, the design of the buoyancy chambers could incorporate deballasting apparatus which will expel water intentionally placed in them. This would allow the anchoring system to be installed with a minimum predetermined preload force in the ballasted condition so that the installation loads are minimized. Once the anchoring system is completely installed the buoyancy chambers are then "deballasted", thereby increasing the buoyancy force in the buoyant portion of the anchor element and increasing the preload force, thus, maximizing the magnitude of the available mooring-/support restraining force. Alternatively, additional buoyancy can be achieved by increasing the number or size of buoyancy chambers after initial installation. It may also be convenient to re-ballast the system at a later date for replacement of an element, modification, repair or removal.

Deballasting may be effected by the provision of flexible piping between adjoining upper and lower parts of adjacent buoyancy chambers. There would be a connection to ballasting/deballasting equipment, i.e. pumps, valves, storage vessels, etc., at the highest end of the uppermost buoyancy chamber and an outlet at the lowest end of the bottom-most buoyancy chamber. This would provide the means for expelling the liquid within the inter-connected chambers by injecting compressed air or gas into the top of the buoyant section's chambers thus displacing the liquid out of the bottom outlet into the sea.

Ballasting (or re-ballasting) could be accomplished, using the same piping, by venting the system through the uppermost connection thus allowing sea water to enter in through the lowest most connection. Thus, the deballasting inlet and outlet become the ballasting outlet and inlet.

There should be provision in the design of the buoyancy chambers for ensuring they maintain a minimum positive (upward) buoyancy to preclude loss through sinking if ballasting is done accidentally. The provision of inert low density foam units within the chambers or the provision of separate non-ballastable volumes as a part or attachment to the chambers could be provided.

Deballasting may also be accomplished by the removal of pre-installed weights, i.e. heavy metal attachments or heavy chains, from the buoyancy chambers or other components of the buoyant portion. Likewise, ballasting could be accomplished by the addition of such weights.

In a mooring/support system embodying the present invention, the geometrical shape of the bridle element may be octagonal with the opposed ends of each side of the bridle element being connected to an anchor element. The anchor elements then extend to the sea bed to a common sea bed anchor. The anchor elements are preferably equiangularly spaced.

Although eight anchor elements are mentioned as preferred, the number of anchor elements can be varied to suit a particular use. Also the system geometery can be made irregular to suit a sloping sea bed or special application. Embodiments are envisaged in which there are several layers of anchoring elements for supporting a structure by multiple guying.

In the case of ships, particularly semi-submersible type vessels, it has been found to be advantageous to replace the vertical downward component, that would have been imposed by conventional anchors on the ship, by the introduction of ballast into the hull of the ship. This lowers the center of gravity of the hull and consequently increases the stability and payload capacity.

The buoyant portion may adopt the shape of one half of an inverted catenary, the non-buoyant portion being one half of a normal catenary. An advantage of adopting a buoyant catenary is that the anchoring forces can be increased by increasing the buoyancy force. This contrasts with conventional prior art anchoring systems in which it is necessary to increase the weight of the anchor lines which is costly and introduces the added complication of excessive vertical force components on the moored or supported object.

According to the present invention, there is also provided a method of installing a mooring/support system comprising: attaching a plurality of anchor elements, each having a buoyant portion, to the sea bed, wherein respective buoyant portions are disposed at the end of respective anchor elements which are remote from the sea bed; and attaching a bridle element to each of said remote buoyant portions thereby linking adjacent anchor elements.

After attachment of the anchor elements to the sea bed, the ends of pairs of anchor elements are preferably linked together by a restraining means so that the anchor elements can be disposed at least in the vicinity of their operational configurations. The restraining means is removed after attachment of the bridle element.

Preferably, diametrically opposed pairs of anchor elements are linked by said restraining means.

The buoyancy of the buoyant portions may be made relatively low during installation of the system. The buoyancy may be increased after attachment of the bridle element, thereby increasing the system's preload while deploying the system into its operational position above the sea bed.

There may be eight anchor elements, in which case, the bridle element is cf an octagonal configuration.

During installation of the mooring/support system the loadings on the anchor element's restraining means and/or bridle element may be varied by regulating the buoyancy of the buoyant portions.

The buoyancy of the buoyant portion can be regulated by adding or removing ballast to/from the buoyant portion. Alternatively, the buoyancy can be varied by adding or removing buoyant units to/from the anchor element.

Attachment of the bridle element to each anchor element may be made by positioning an installation vessel above the end of the anchor element remote from the sea bed, connecting onto said end at the sea surface and attaching the bridle element thereto. Said ends may be displaced by pulling upwardly on the restraining means or pulling on buoyed pendant lines connected to said ends.

The position of said remote ends of the anchor elements may be indicated by means of a buoy, wherein said remote ends correspond to mooring points to which a marine structure can be moored or supported.

The buoyancy of the buoyancy portion may be such that when the vertically applied pulling on the restraining means is removed, the ends of the anchor elements remote from the anchored ends sink to a ballasted height above the sea bed, restrained in this position by the attached bridle element. In this case, the system can be prepared to accommodate a vessel by de-ballasting the buoyancy portions thereby causing the ends of the anchor elements to rise further above the sea bed to an operational height, which in turn increases the pre-load in the mooring support system.

BRIEF DESCRIPTION OF THE DRAWINGS

Embodiments of the present invention will now be described by way of example with reference to the accompanying drawings, in which.

DETAILED DESCRIPTION OF THE PREFERRED EMBODIMENTS

Figure 1:
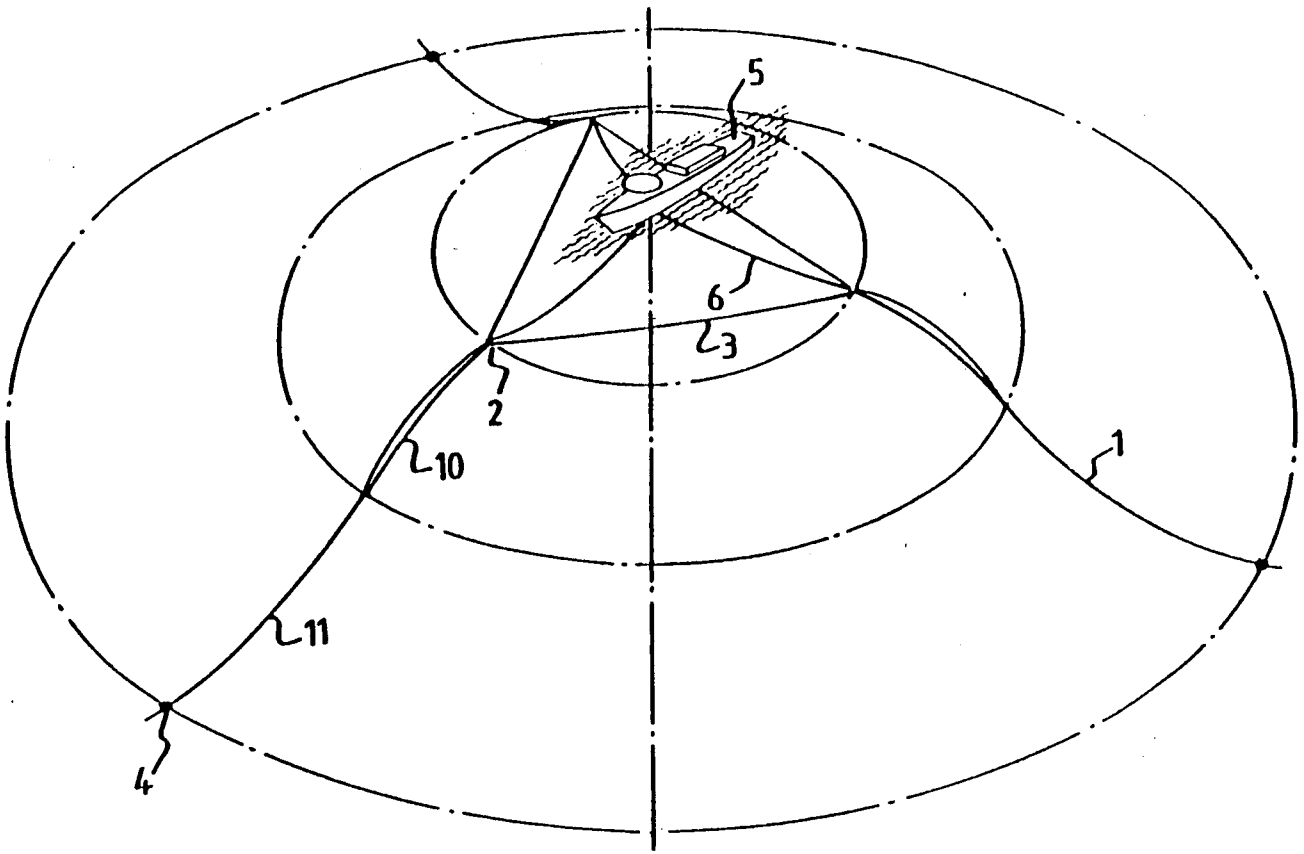
FIG. 1 is a perspective view of a mooring/support system mooring a ship according to the present invention.

FIG. 1 shows a mooring/support system 100 having three separate anchoring elements 1 each connected at one end to a triangular bridle element 3 (containing three individual bridle segments), and at their opposite end to a corresponding sea bed anchor 4. A ship 5 is moored within the bridle element 3 and is maintained in position by ship's restraining lines 6 which are coupled to respective mooring/support points 2 defined by the connection point between the anchor elements 1 and the bridle element 3. Each anchor element 1 consists of an indicated a buoyant portion 10 and a non-buoyant portion 11.

Figure 2:
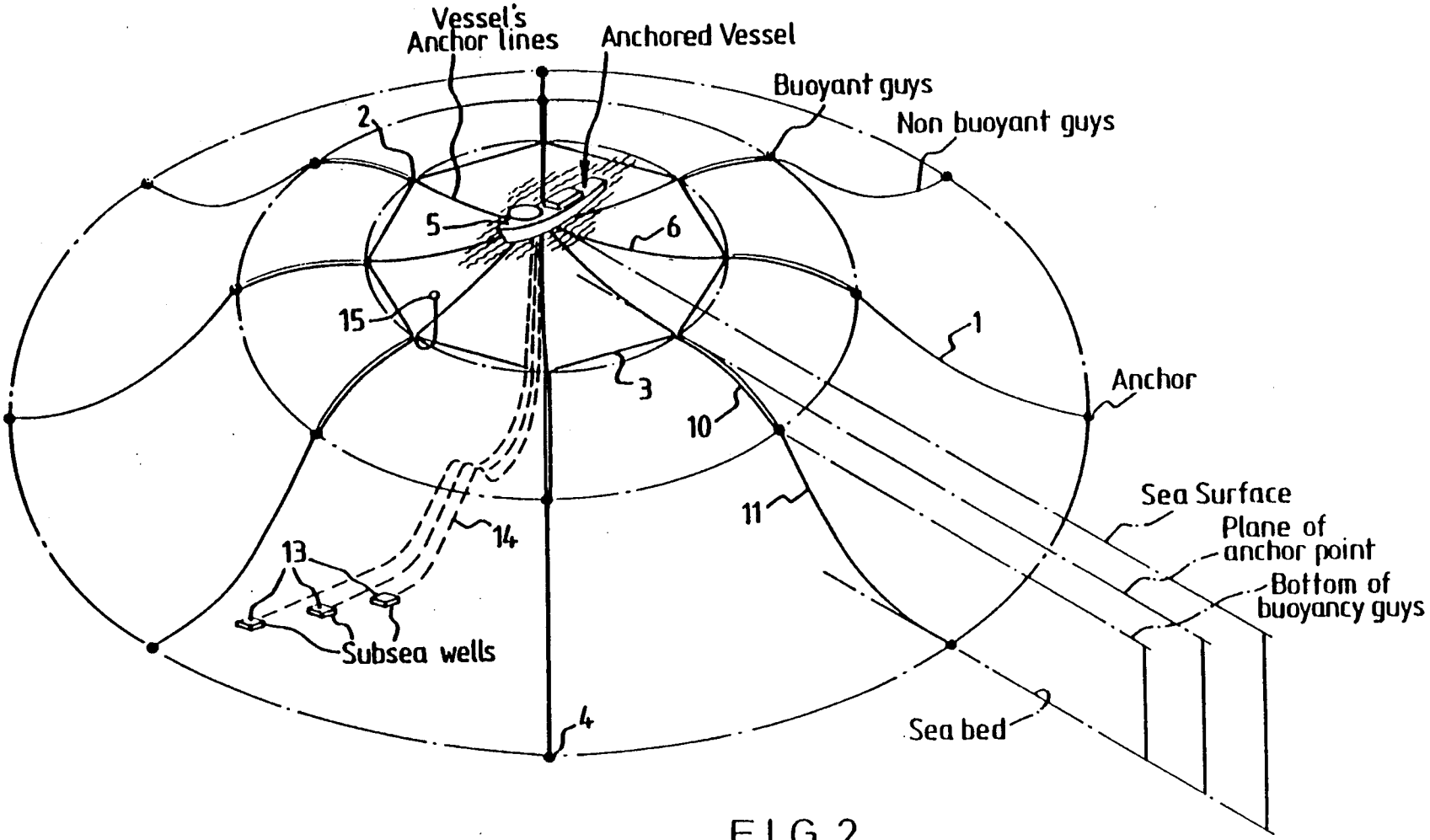
FIG. 2 is a perspective view of a mooring/support sysem according to a second embodiment of the present invention.
Figure 3:
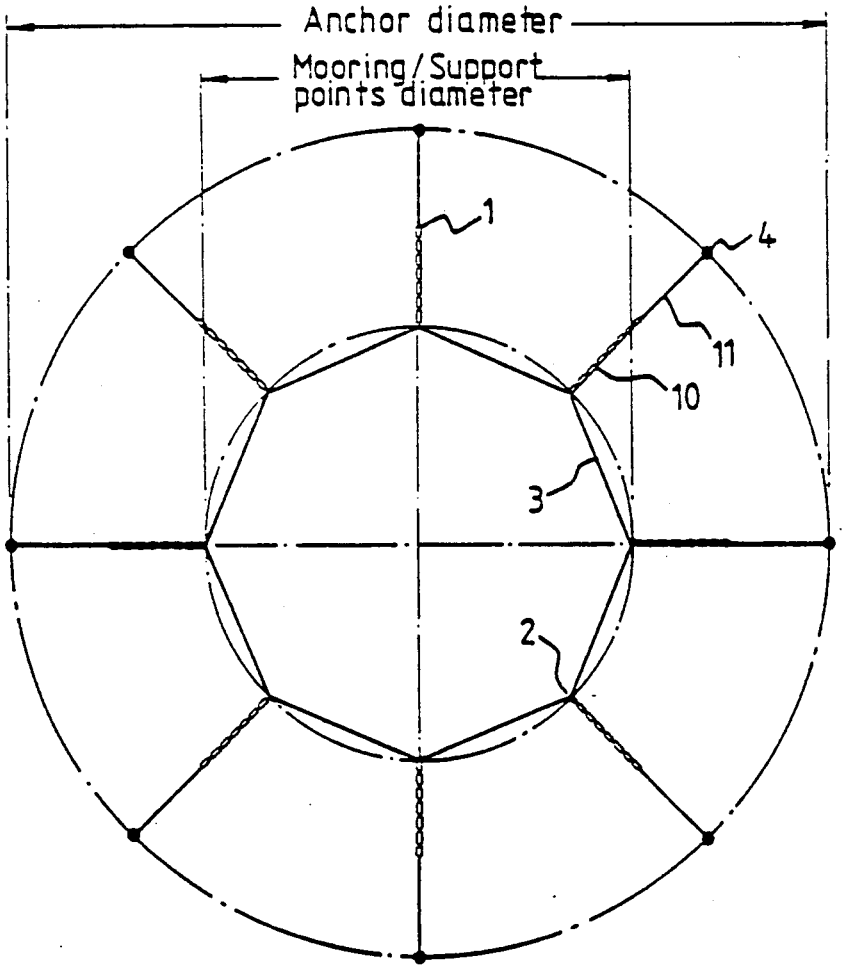
FIG. 3 is a diagrammatic plan view of the mooring-/support system of FIG. 2.
Figure 4:
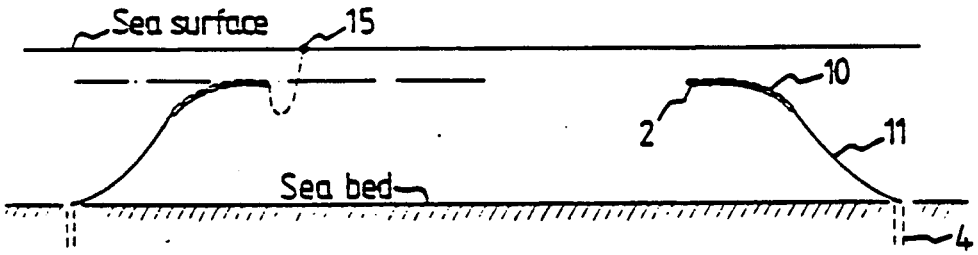
FIG. 4 is a diagrammatic part sectional view of the mooring/support system of FIGS. 2 and 3.

A second embodiment of a mooring/support system 100 constructed in accordance with the principles of the present invention as shown in FIGS. 2 to 4. In this embodiment, eight separate anchoring elements 1 each connected at one end to a mooring/support point 2 and attached to an octagonal bridle element 3 containing eight individual bridle segments) and connected at their opposite end to a corresponding sea bed anchor 4. A ship 5 is moored substantially centrally within the octagonal bridle element 3 by means of a series of horizontal ship restraining lines 6 which extend outwardly from the ship to connect with respective interconnecting points, i.e. mooring/support point 2, of the anchor elements 1 with the bridle element 3.

Each anchor element 1 comprises a buoyant portion 10 and a non-buoyant portion 11. The buoyant portion 10 has a plurality of interconnected hollow steel chambers connected to an anchor chain so as to exert an upward force on the anchor element 1 due to the submergence of the hollow steel cylinders in water. Subsea oil or gas wells 13 are illustrated together with flexible risers 14 extending between the sub-sea wells and the anchored vessel 5.

When initially installing the mooring/support system 100 the buoyant force produced by the hollow chambers in the form of hollow cylinders, spheres, or buoyancy units could be kept as small as possible to produce minimum restraining forces within the system. Once the system is completed, and full operational buoyancy is provided, the system's preload will be increased. This will enable the system to provide a greatly stiffer restraint. It is still possible to install the system of the present invention with full operational buoyancy using larger installation equipment. A method of installation of the mooring/support system 100 will be described in further detail below.

When buoyant portion 10 is acted upon by the upward buoyant force along its length, corresponding forces are imparted into the anchor elements 1. These forces create reactions, which act upon the various components (namely the bridle element 3 and the non-buoyant portion 11), that restrain the buoyant portion 10 imparting a tension force in the non-buoyant portion 11 and the bridle element 3. This is because the buoyant portion 10 is restrained at its upper end by the bridle element 3 and at its lower end by the non-buoyant portion 11 which is attached to the sea bed anchor 4.

Once the ship 5 is located within the mooring/support system 100, the ship's lines 6 are connected to the mooring/support points 2 of the system. Accordingly the ship's lines 6 will impose a loading upon the anchoring element which comprises a horizontal component of force, $F_H$, and a vertical component of force $F_V$. The horizontal component of this force will oppose the preload force $H_i$. However, as long as the magnitude of the horizontal force $F_H$ is less than the preload, force $H_i$, horizontal displacement of the mooring/support point 2 will be small, that is, non-appreciable horizontal displacement will occur if the horizontal force $F_H$ is less than $H_i$.

Once the horizontal force $F_H$ exceeds the preload force $H_i$, the horizontal displacement at the mooring support 2 will increase in a manner similar to that of a system without a bridle element 3.

In fact, it may be desirable to design the system with a preload force $H_i$ which is less than the maximum operational load, so that additional compliance can be attained when higher forces are encountered in order to minimize hydrodynamic loading that would be inherent in "non-movable" objects.

If the ship's lines impose a vertical component of force Fu on the mooring/support system 100 a vertical displacement will occur and there will also be a redistribution of stresses in the mooring/support system 100. This may, possibly, effect the magnitude of the force $H_i$ and may, possibly, cause a small horizontal displacement of the mooring/support point 2.

The completely assembled mooring/support system 100 is designed to accommodate these displacements and forces, as well as to provide minimization of the vertical force components imposed onto the mooring/support points 2 and on the moored/supported object 5. Also, since the assembled system is preloaded, the connected components will provide restraining capacity and rigidity to the mooring/support points 2 so as to maintain the moored ship, supported tower, or other object in a fixed location within the tolerance of a few meters.

The non-buoyant portion 11 of each anchor element 1 comprises a chain or cable which is preferably slightly longer than the water depth in which it is used. This is to ease the installation of the total system and also to allow connection to the sea bed anchors 4 while the buoyant portions are supported by floating near the surface. However, the length of the non-buoyant portion 11 can be less or greater than the water depth if this provides other benefits. Advantageously, the weight of the non-buoyant portion 11 reduces the magnitude of the vertical uplift force on the sea bed anchor 4, which is implanted into the ocean floor, thereby sustaining the vertical and horizontal reactions that would be imposed by the mooring/support system 100.

In cases where it may be desirable to eliminate vertical uplift on the anchor 4, heavy or weighted chains may be disposed on the lower portion of the anchor element. The weight of the chains may be such as to exceed vertically upward forces, resulting from loading and buoyancy. The chains will rest on the sea floor and will be restrained in a horizontal direction by the anchor 4. In this case, the anchor 4 would be subjected to only a horizontal force.

The mooring/support system 100 provides a special advantage when used in conjunction with such anchorings as it minimizes the vertical component of tension in the anchor chains normally allowing the use of shorter lengths of chain, or less massive chain. This provides special saving in materials and reduces the area required by the anchor pattern layout. However, it is necessary to cater for the uplift force introduced by the buoyancy portion 10 of the anchor element 1.

The bridle element 3 is a cable or other flexible element that interconnects the radially extending anchor elements 1. The geometry of the bridle element 3 is determined by the number of anchor elements utilized in the mooring/support system 100 so that a suitable preload force is imposed into the mooring/support system 100. The bridle element 3 sustains tension forces that are imposed on it by the anchor element 1 at the mooring/support points 2. Any external loading imposed on the mooring/support system 100 is transferred from the ship's lines 6 directly to the mooring/support points 2 at the end of the buoyant portions 10 of the anchor elements 1. The preferred position of the bridle element 3 during operation is below the sea surface in a horizontal location that would minimize the vertical inclination of the ship's lines 6.

The upper end of any buoyant portion 10, i.e. the mooring/support point 2, reacts against the bridle element 3, which itself is restrained by the buoyant portions 10 of other anchor elements 1. In the vertically free condition this combination of pull and reaction by the anchor element creates the horizontal preload force $H_i$.

Prior to connecting the moored/supported object 5 to the mooring/support system 100 these forces would introduce a tensile force, $T_{Bi}$, into the bridle element 3.

For the purposes of this disclosure the force $H_i$ that is created in the assembled mooring/support system 100 is designated the "preload" and can be higher in magnitude than the maximum horizontal component of force that will be imposed by the operational loading of the ship's lines 6 connected to the mooring/support points 2. Such loadings are illustrated in the following vector diagrams, shown in plan.

The total horizontal projected distance and vertical height of the total cable system is calculated assuming it is held in equilibrium by equal and opposite horizontal tension forces at each end and by the buoyant and gravity forces (also equal and opposite) acting on it vertically.

The vertical and horizontal projections of each component are then calculated.

The length of the imaginary portion of the buoyant section 10 is a function of the vertical force acting on the real buoyant end ($V_a$ acting on point A). For ease of calculation the imaginary portion has the same properties as the real buoyant section. The imaginary length varies with vertical loads encountered.

The real portion of the buoyant section 10 has the normal characteristics of a regular catenary segment except that the forces acting on it are opposite to the gravity vector. So it is really an inverted catenary segment of a specified length.

The real portion of the gravity section is a segment of

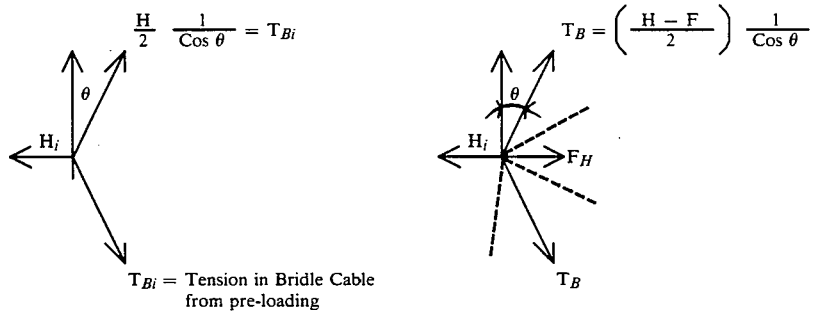

Stresses in Bridle Element Due to pre-load only

Stress in Bridle Element During operation $T_{Bi}$=Tensile force in bridle element due to preload.

$T_B$=Tensile force in bridle element. (Max. is $T_{Bi}$, Min. is 0) The bridle element is a tension carrying device. When the magnitude of the applied force $H_F$ attains that of the preload, the stress in the bridle element is theoretically zero and for further increases in the force $F_H$ the system functions as though there were no bridle element.

$H_i$=Preload in anchor element that acts and reacts on the bridle element.

$F_H$=Horizontal component of force in ship's lines.

$F_V$=Vertical component of force in ship's lines.

F=Tensile force in ship's lines. This can be due to operational loads but it could include induced force created by the ship preloading its lines against each other.

NOTE: If $F_H$ is not axial to the anchor element the off axis component will introduce a difference in the stresses of adjacent bridle element parts.

Figure 8:
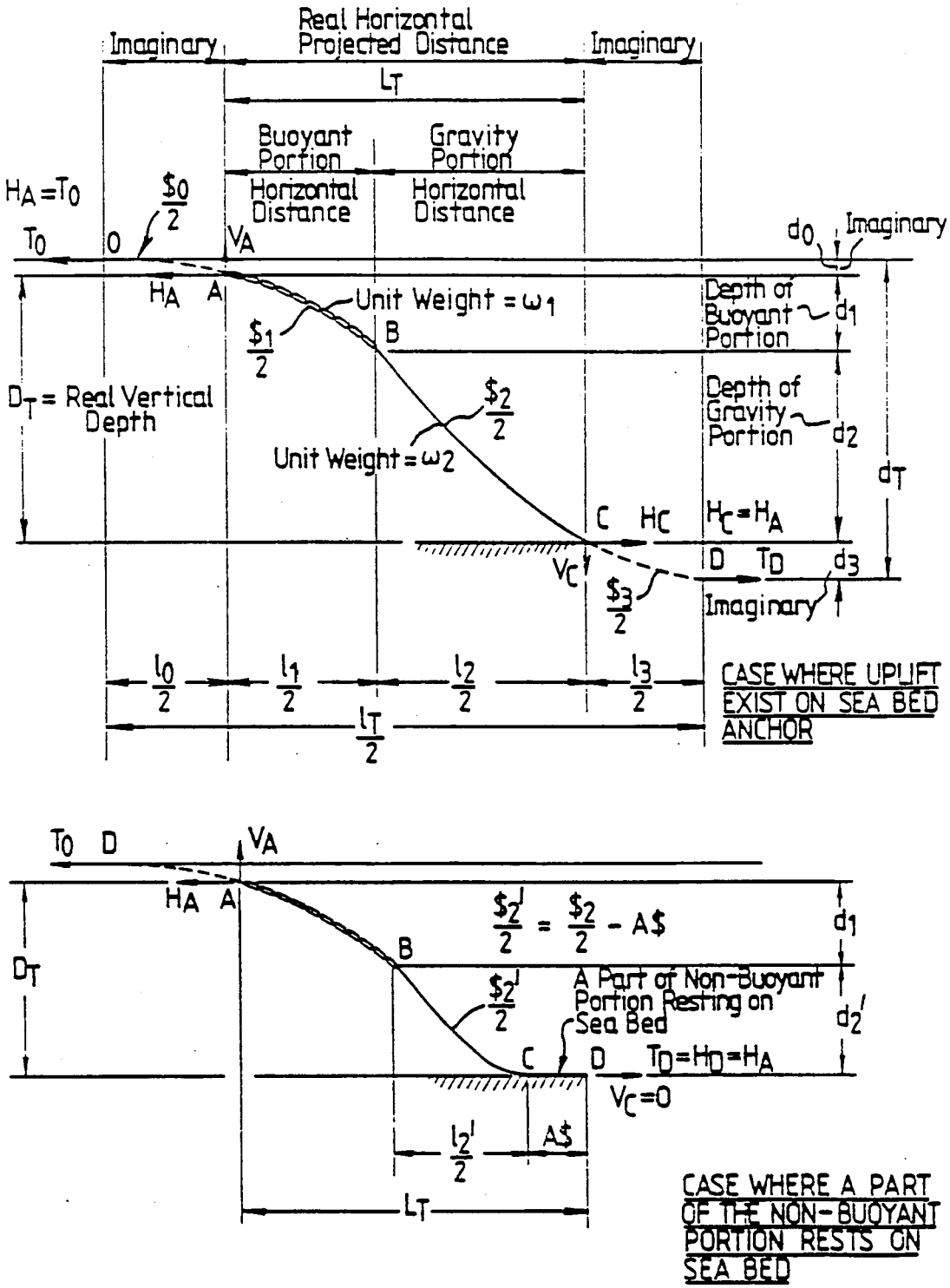
FIGS. 8*a* and 8*b* are diagrammatic representations of an anchor element which illustrates the means used to calculate system geometry and restraining forces due to the loadings applied to the mooring/support point. The calculations utilize common catenary formulae.

To determine mathematically the horizontal and vertical restraining forces exerted by the anchor element 1, and the horizontal and vertical components of length of various portions of each anchor element 1 it is necessary to consider the element's parts in terms of segments of a catenary with the buoyant portion 11 being one half of an inverted catenary, and the non-buoyant 10 portion being one half of a normal catenary as indicated in FIGS. 8*a* and 8*b*. The mathematics presented ignore any change in length of the elements due to elongation from induced stresses. However, the effects of this are secondary and can be determined by trial and error using the formulae presented.

a normal catenary of a specified length.

The imaginary portion of the gravity section is assumed to have the same properties as the real portion to simplify the analysis. The imaginary length varies with the loadings. Special account has to be taken in this analysis when the loads are such that a part of the gravity portion rests on the sea floor.

Equations developed for the various components acting under loadings enable the forces and geometery of the real system to be determined.

Figure 7:
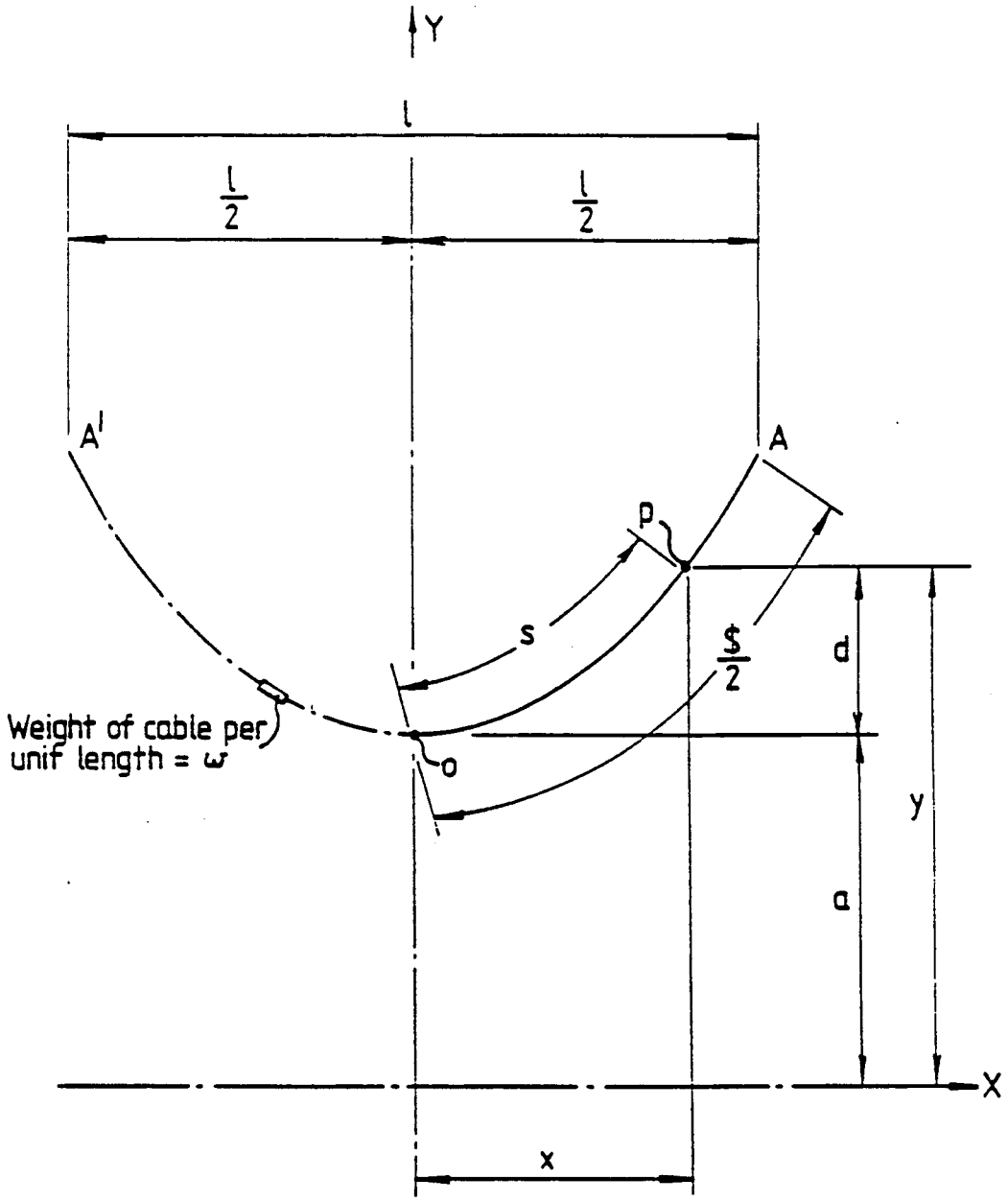
FIG. 7 is a diagrammatic representation of a catenary curve with the various parameters indicated to assist in the definition of mathematical formulae used to explain operation of embodiments of the present invention.

The standard formulae for calculating various parameters are:

Referring to FIG. 7.

$$s = a\,\mathrm{Sinh}\left(\frac{x}{a}\right),\ y = a\,\mathrm{Cosh}\left(\frac{x}{a}\right),\ y^2 = a^2 + s^2$$

where s is the length, along the catenary curve, from the lowest point, Point O, to the point defined by distance "x" i.e. Point P.

a is known as the "Catenary Parameter". It is the distance from the lowest point on the curve, Point O to the origin of the "y" axis. (When x=o, y=a.) It should be noted that the value of the "Catenary Parameter" is a function of the stress in the catenary at its lowest point divided by the weight per unit length. i.e.

$$a = \frac{H}{W}.$$

Therefore, the mathematical origin of the coordinate system changes with loadings of a catenary cable.

x is the horizontally projected distance from the origin of the x axis.

y is the vertically projected distance from the origin of the y axis.

The depth of the catenary is calculated from $$d = y - a = a\left(\sqrt{1 + \left(\frac{s}{a}\right)^2} - 1\right)$$

where d is the vertically projected distance from the point in question on the curve, i.e. Point P, to the lowest point on the curve, i.e. Point O. This is often referred to as the depth of the catenary.

Where two cables of different unit weights are utilized (the cables being jointed together and acting in opposite directions), the buoyant and gravity depths $d_B$ and $d_G$ of the catenaries can be calculated from the following relationships because the tension in both catenaries is the same at the connection point.

$$d_G = \frac{W_1}{W_2} \cdot d_B$$

$W_1$ represents the buoyant force per unit length acting upwardly, and $W_2$ represents the gravity force per unit length acting downwardly.

Knowing that the buoyant force upwards is equal to the gravity force the relationship between cable weights for the buoyant catenary parameter $a_1$ and the gravity catenary parameter $a_2$, is $$a_2 = \frac{W_1}{W_2} \cdot a_1$$

As segments of catenary curves are utilized it is simpler to develop equations utilising half lengths, i.e.

$$\frac{S}{2},$$

and half horizontal projections, $$\frac{l}{2}.$$

Therefore when the length of a catenary element is known or to be calculated it is referred to as $$\frac{S}{2}.$$

$$\frac{S_1}{2} = \text{Length of buoyant portion}$$

-continued $$\frac{S_2}{2} = \text{Length of gravity portion}$$

The various horizontally projected lengths $$\frac{l_0}{2}, \frac{l_1}{2}, \frac{l_2}{2}, \frac{l_3}{2}, \frac{l_B}{2}, \frac{l_a}{2}, \frac{l}{2},$$

and $^{L}T$ for the segments of the various components of the total curve can be obtained utilising the following formulae in their simplified form. Definitions of terms $A_0$, $A_1$, $A_2$, $\Delta S$, etc. follows.

$$\frac{l_1}{2} = \frac{H}{W_1} \cdot \mathrm{LN}\left[\frac{(A_1 + \sqrt{A_1^2 + 1})}{(A_0 + \sqrt{A_0^2 + 1})}\right]$$

where $$\frac{l_1}{2}$$

is the horizontal projection of the length of the buoyant portion of the anchor element, and $$\frac{l_2}{2} = \frac{H}{W_2} \cdot \mathrm{LN}\left[\frac{(A_1 + \sqrt{A_1^2 + 1})}{(A_2 + \sqrt{A_2^2 + 1})}\right]$$

where $$\frac{l_2}{2}$$

is the horizontal projection of the length of the non-buoyant portion of the anchor element.

The total horizontally projected length of the real portions of the anchor element being, upon simplification, $$L_T = \frac{l_1}{2} + \frac{l_2}{2}$$

the various vertical projections of the segments can be obtained utilizing the following formulae $$d_1 = \frac{H}{W_1}(\sqrt{A_1^2 + 1} - \sqrt{A_0^2 + 1})$$

where $d_1$ is the vertical projection of the buoyant portion of the anchor element and $$d_2 = \frac{H}{W_2}(\sqrt{A_1^2 + 1} - \sqrt{A_2^2 + 1})$$

where $d_2$, is the vertical projection of the non-buoyant portion of the anchor element and $$D_T = d_1 + d_2$$

where $D_T$ is the height above the sea bed of the upper attachment of the anchor element A negative value of $A_2$ indicates that the lower end of the anchor element is resting on the sea floor. Therefore special account has to be taken in determination of system geometery and stresses.

The length of cable resting on the sea floor, when $A_2$ is negative, can be determined by use of the following formula:

$$\Delta S = -\frac{H}{W_2}(A_2)$$

and the geometery of the remaining portion of the anchor element can be determined by substituting a value of zero for $A_2$ in the aforementioned equations.

Additional definitions of terms follow:

where $L_T$=Total horizontal projected length of the real anchor element

H=The horizontal component of the tension in the anchor element

LN=Symbolic notation for the natural logarithm $$A_0 = \frac{1}{H}(V_A)$$

$$A_1 = \frac{1}{H}\left(V_A + \frac{S_1}{2}\cdot W_1\right)$$

$$A_2 = \frac{1}{H}\left(V_A + \frac{S_1}{2}\cdot W_1 - \frac{S_2}{2}\cdot W_2\right)$$

$V_A$=Vertical force acting on the real upper terminal end of the anchor element. Point A.

ΔS=Length of the non-buoyant portion of anchor element resting on sea floor.

$D_T$=Real vertical height of the anchor element. It equals $d_1+d_2$. i.e. Sum of depth of buoyancy portion plus the depth of the gravity portion.

Figure 5:
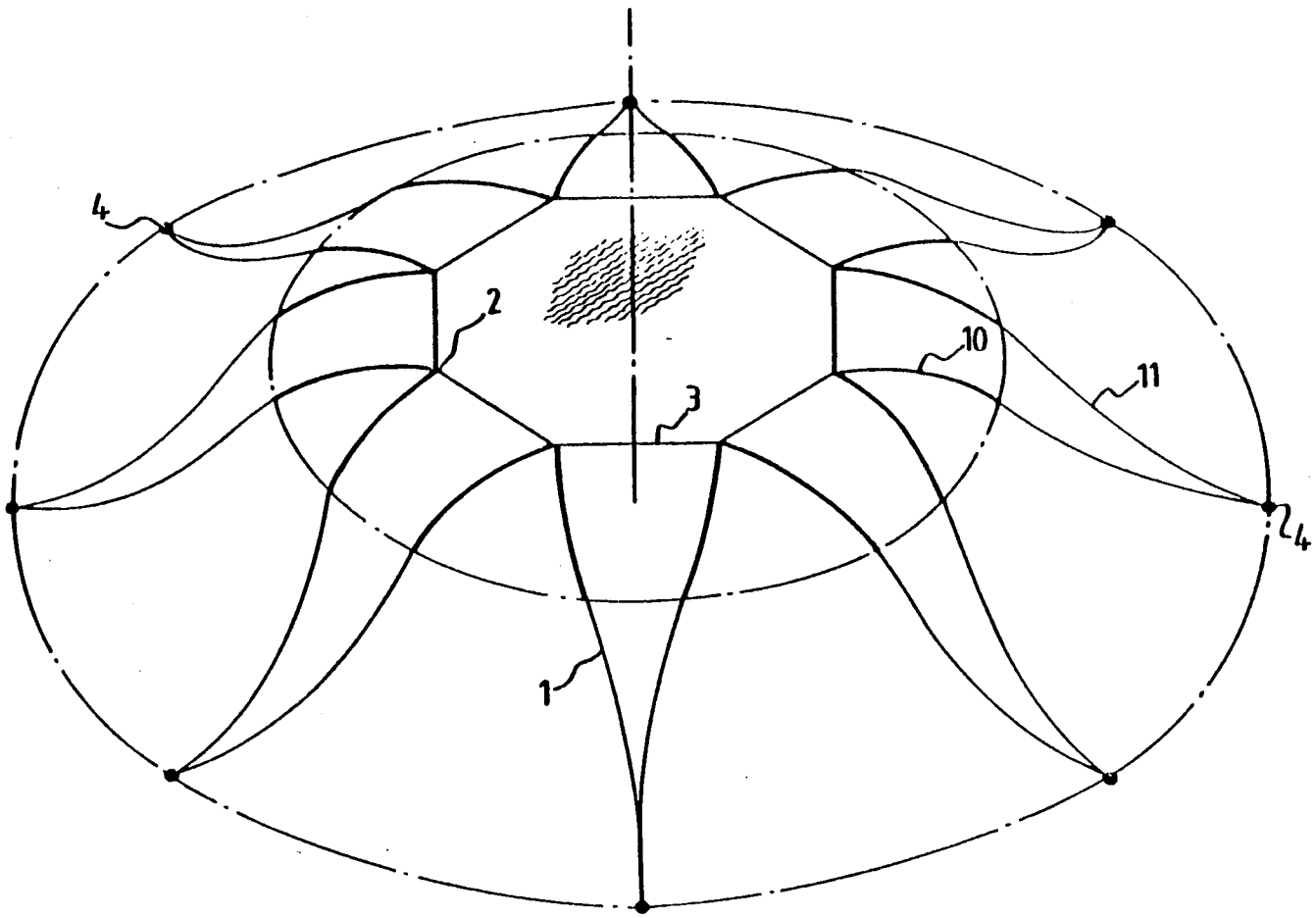
FIG. 5 is a perspective view of a mooring/support system similar to that shown in FIG. 2 but utilising twice the number of anchoring elements in order to provide additional safety and redundancy.

In an alternative embodiment of the invention, as illustrated in FIG. 5, each mooring point 2 of the system may be connected to a pair of anchors 4 by a pair of anchor elements, 1.

Figure 6:
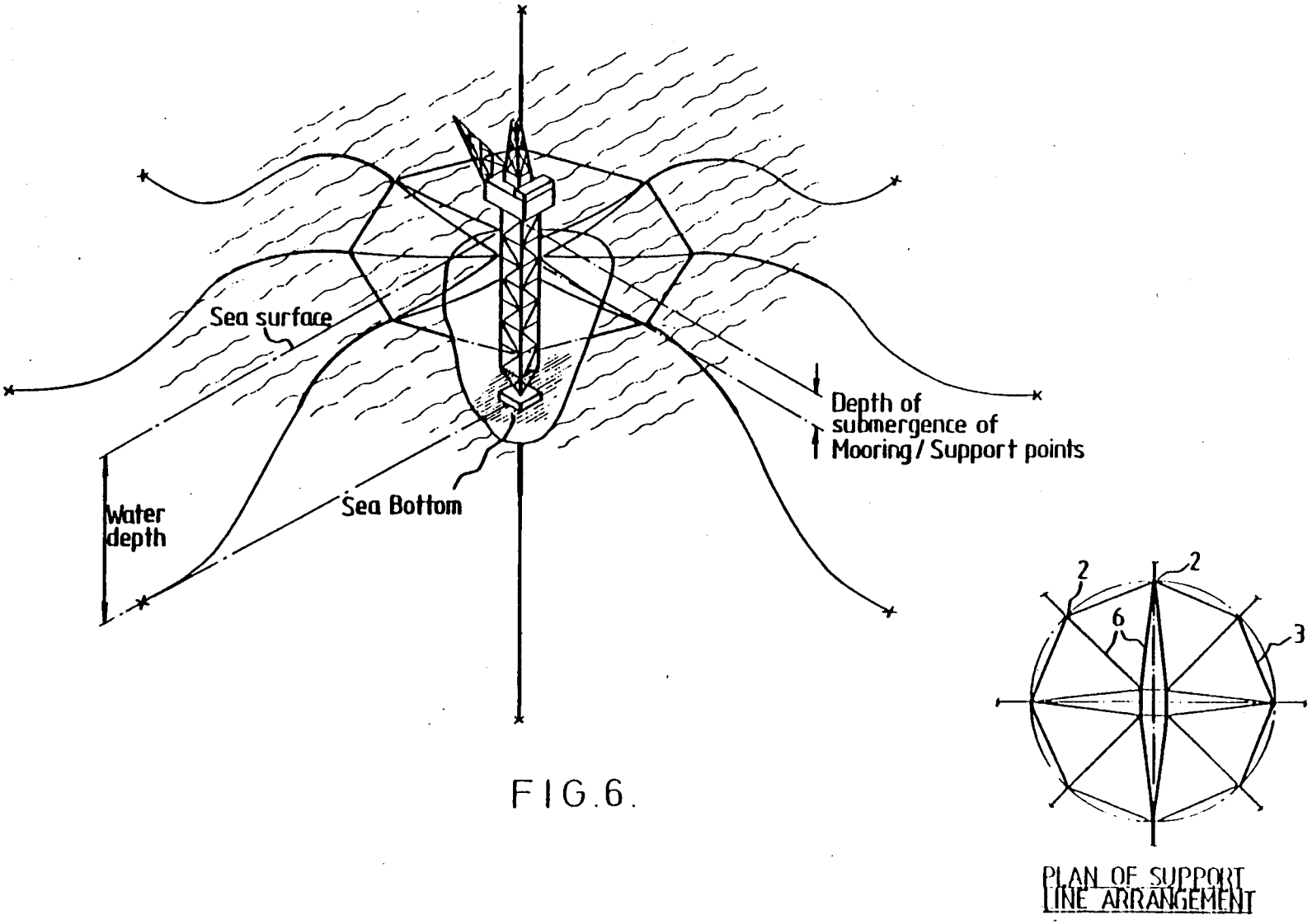
FIGS. 6*a* and 6*b* show the system of FIGS. 2 and 3 supporting a tower structure by means of an arrangement of horizontal supporting lines.

FIGS. 6*a* and 6*b* show how a square tower structure may be supported by an octagonal mooring support structure. Each mooring/support point 2 is connected to an attachment point at the corner of the tower structure; ideally at the same elevation as the mooring support point. Horizontal support lines may be connected singly, in pairs or other multiples to support the tower laterally. Attachment in multiples may provide some torsional rigidity. The arrangement shown i.e. intended to be an illustrative example of a possible implementation; an actual configuration would be based on geometry and design requirements.

One method of installing the mooring/support system is by initially positioning the anchoring element close to the sea bed to extend radially from a central region. The inner end of the anchoring elements are connected to a common interconnecting point such as a bridle element, while the outer ends are each connected to a respective sea bed anchor.

Initially the buoyancy forces are kept to a minimum so that the system floats just above the sea bed. The buoyancy forces are then increased by adding buoyancy chambers or operating deballasting apparatus until the system attains its operational position, with the common interconnecting point sufficiently below the surface of the sea so that ships can pass over it without contact with the system.

The increase in post installation buoyancy force maximises the magnitude of the system's preload, thereby increasing the available mooring/support restraining capacity.

Another method, where either ballastable or non-ballastable buoyant portions of the anchor elements is described below, with reference to FIGS. 9 to 14.

The anchor elements 1 (comprising non-buoyant portion 11 and buoyant portion 10) would be attached to their corresponding sea bed anchors 4 individually.

Figure 9:
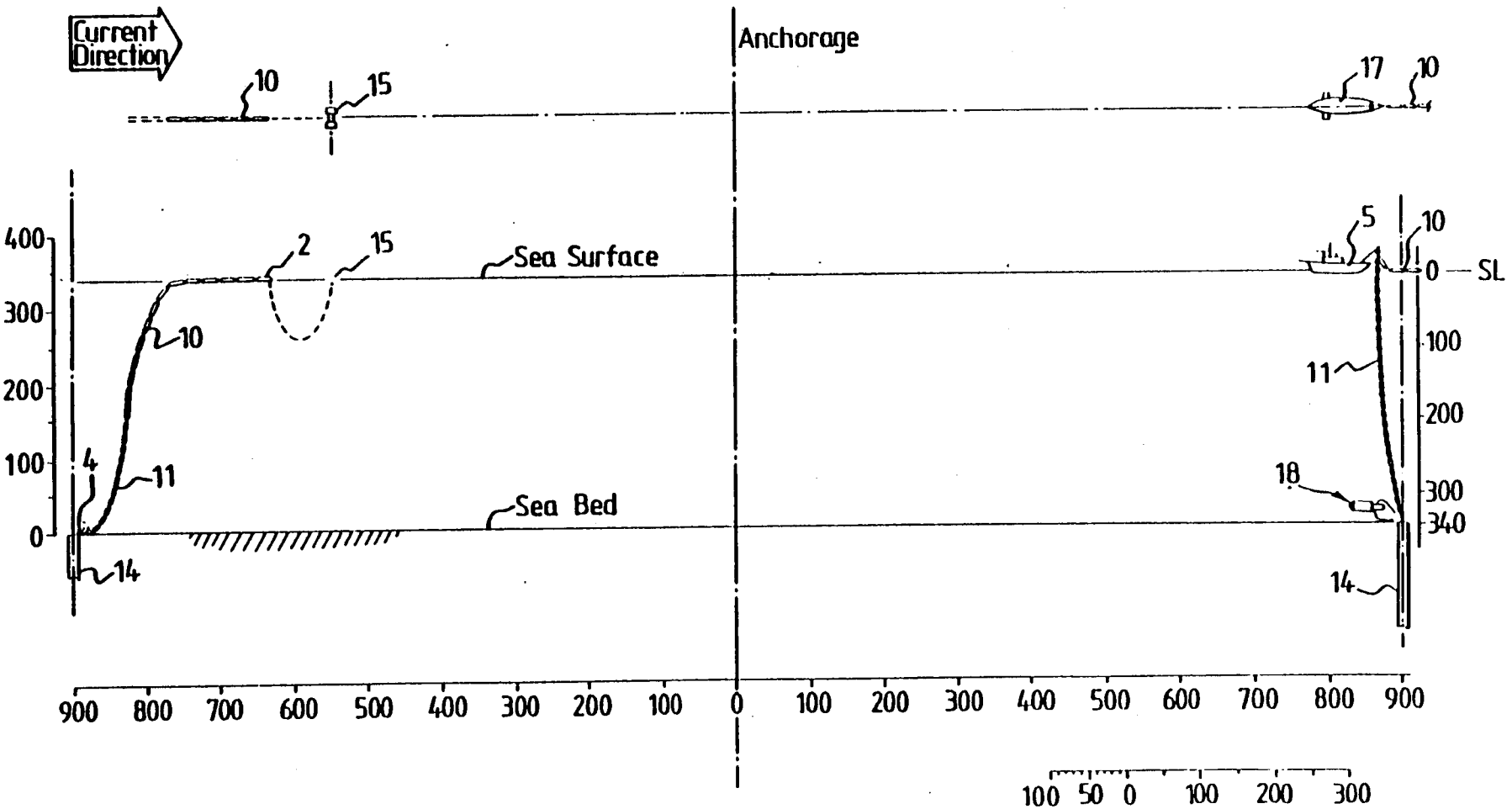
FIGS. 9 to 14 illustrate a sequence of steps which can be taken in a method of installation of a mooring/support system according to the present invention.

As shown in FIG. 9, the up-current anchor 4 is connected to an anchor pile 14 and the anchor element is allowed to drift. The pendant buoy 15 marks the position of the end of the buoyant portion 10. The buoyant portion 10 is ballasted but retains some positive buoyancy.

An installation vessel 17 holds the upper end of the down current non-buoyant portion 11 and allows the buoyant portion 10 to float. The lower end of the non-buoyant portion 10 is connected to an anchor by a remotely operated vehicle 18. The vessel 17 pulls the anchor element towards the up-current anchor element so that is can be joined to the down-current anchor element by a predetermined length of temporary restraining member 18. The length of the non-buoyant portion 11 is slightly greater than the depth of the sea for convenience.

Figure 10:
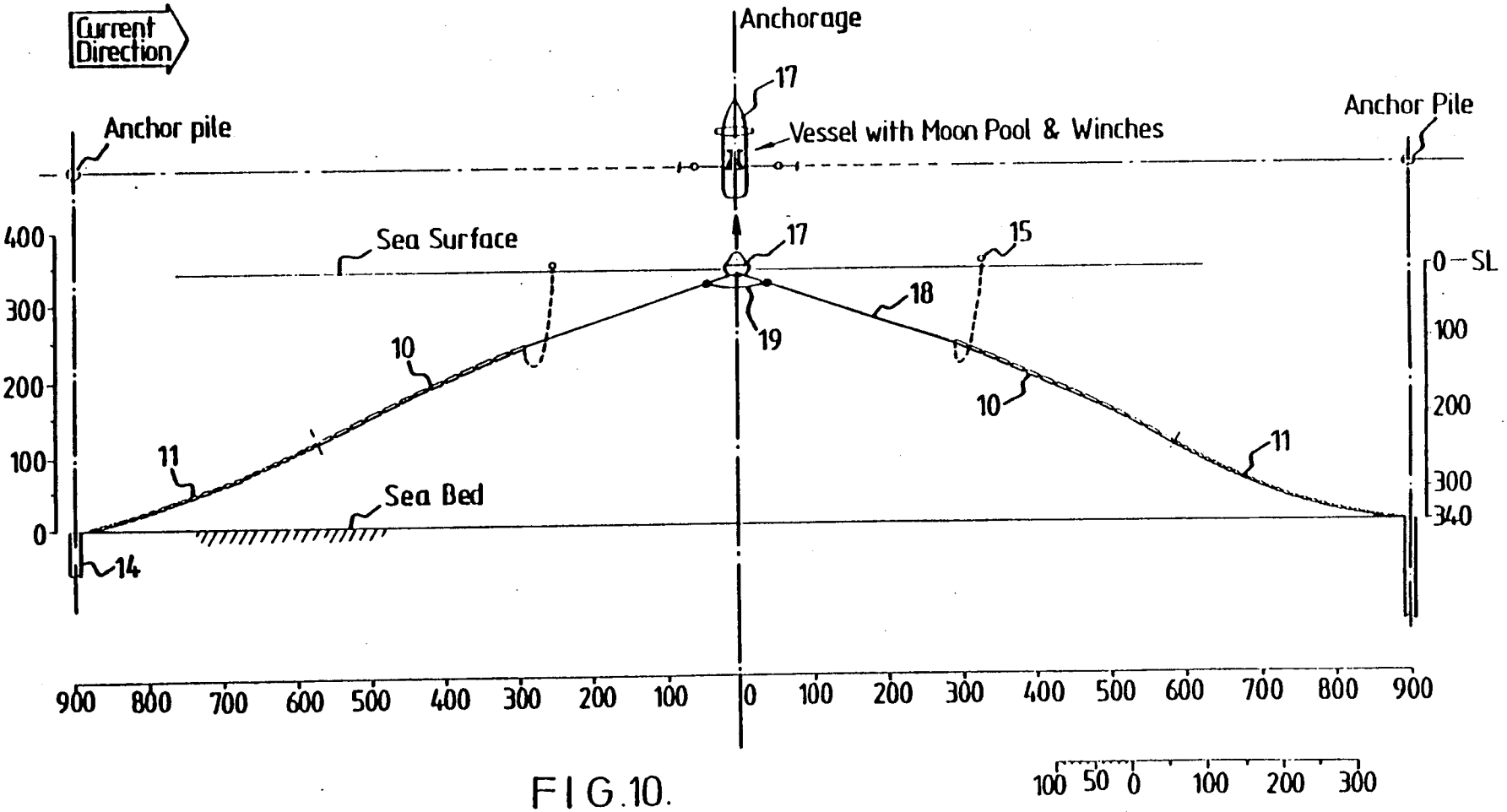

Then diametrically opposed anchor elements would be joined together with a temporary restraining member 18 to cause them to form their operational geometrical configuration, because of the buoyant action on the upper portion of the anchor element and the tensile force imposed on its upper termination. FIG. 10 illustrates the restaining member 18 linking opposite anchor elements.

The vessel 17 takes position midway between the two anchors and winches the two pieces of the temporary restraining members 18 of the anchor elements together. The pieces are winched together until they can be joined to form the temporary restraining member 18 of predetermined length. A temporary central cable link 19 may be provided between the anchor elements. The pendant buoys 15 are connected to the upper ends of the anchor elements to facilitate later retreival. An upward force required for installation of the restraining member 18, in a possible system, might be approximately 8.4 tonnes and 119 tonnes for a ballasted and full buoyancy installation respectively.

Both FIGS. 9 and 10 include plan views of the operation.

After all anchor elements are pre-installed, in pairs, the bridle element would be installed and the temporary restraining members 18 removed. Access to the various attachment parts is effected by pulling upwards, with marine cranes from installation vessels, on pendant lines 15 connected to the mooring/support points 2.

Figure 11:
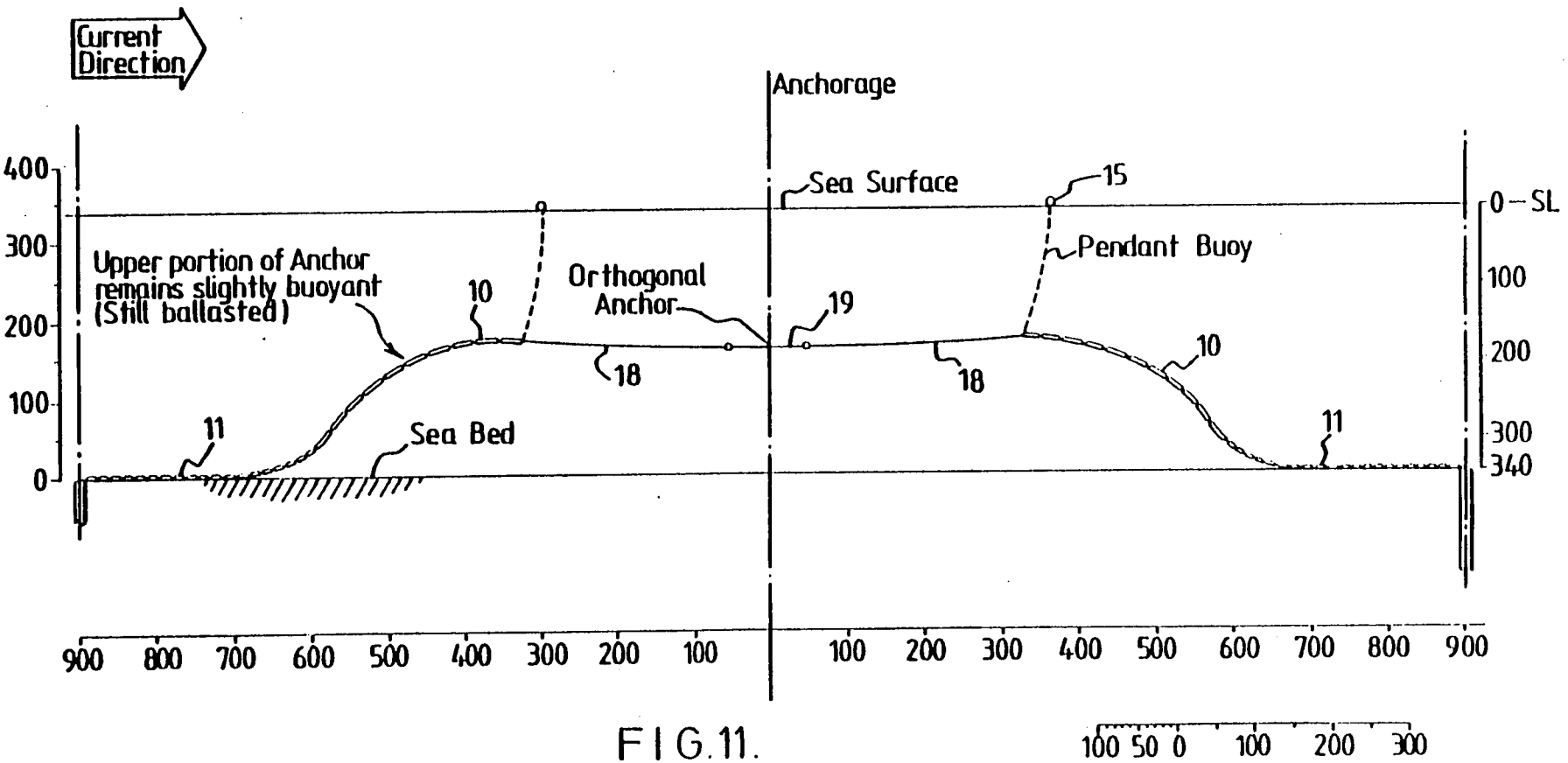

FIG. 11 illustrates a pair of anchor elements after connecting links with the installation vessel have been removed. The non-buoyant portions 10 are in equilibrium above the sea bed.

Figure 12:
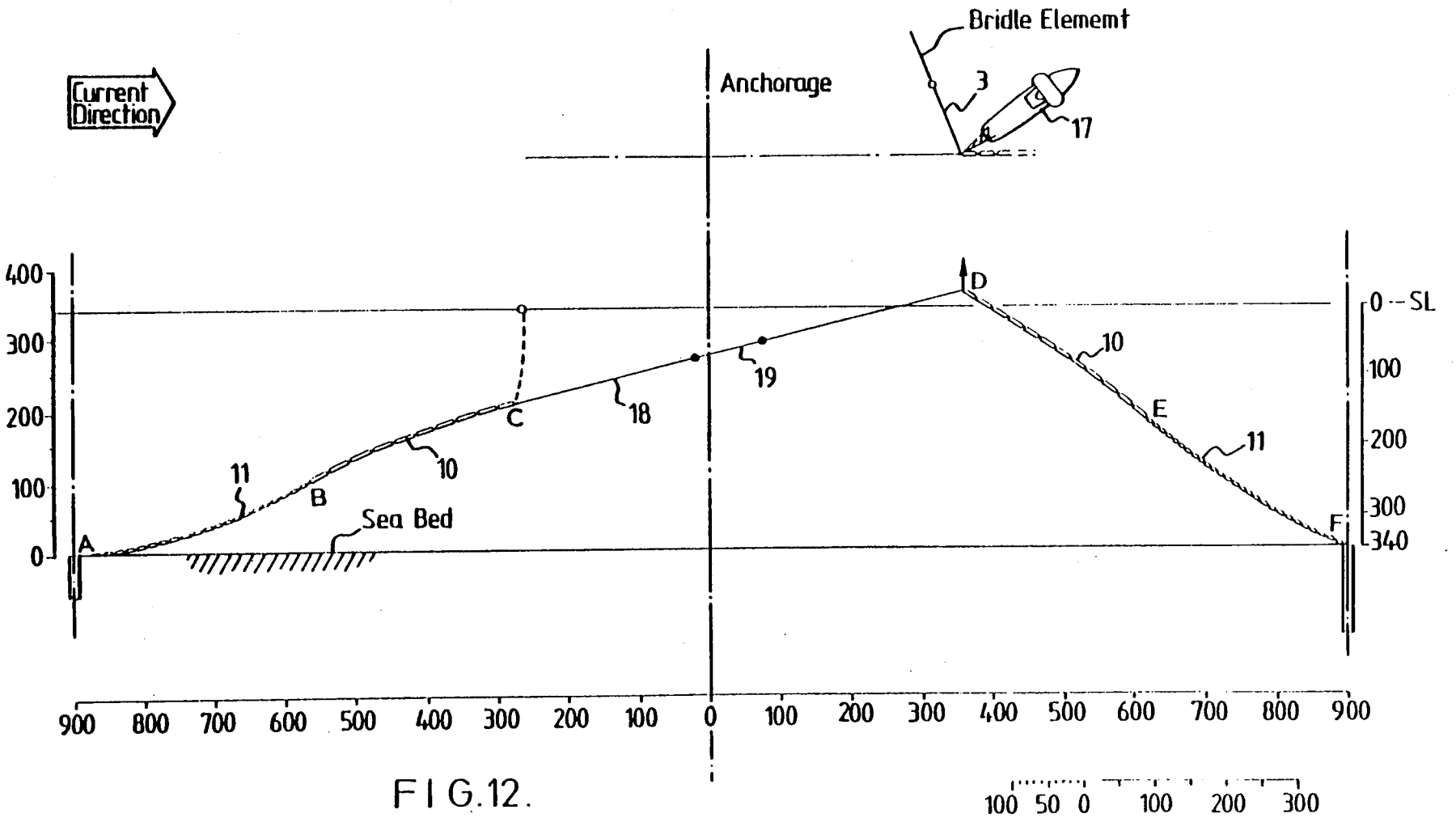

In FIG. 12, the end of the anchor element is lifted for attachment of the bridle element 3. The vessel 17 is positioned over the anchor element's upper end and pulls the end with, for example, a force V of 16 or 240 tonnes for a ballasted or full buoyancy installation respectively. This is the force required to lift one of the paired anchor element's end to the surface for working on it.

If a ballastable type of system is installed the buoyant portion would be deballasted so that operational preload can be attained.

Figure 13:
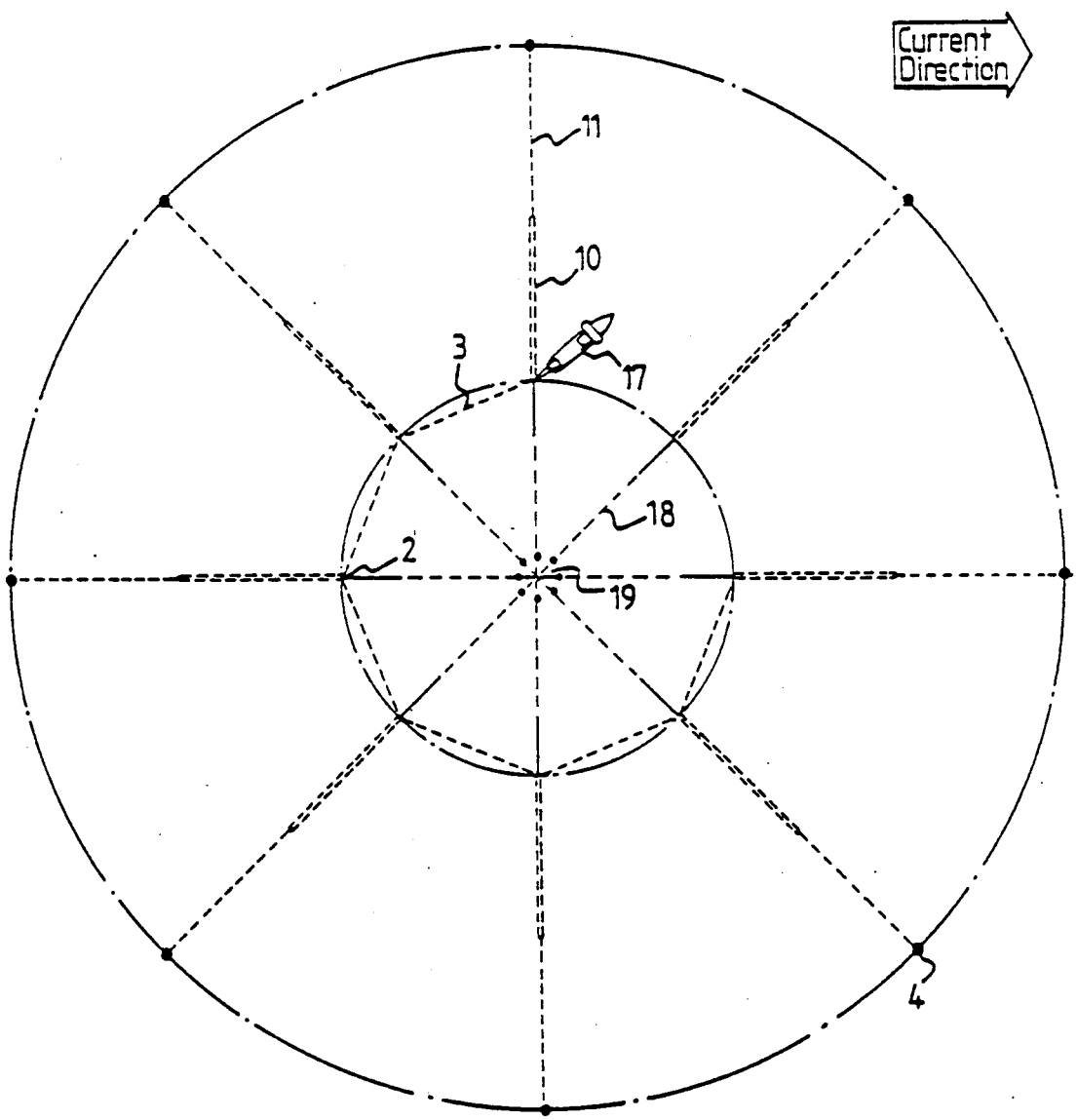

FIG. 13 is a plan view showing installations of the bridle element 3. At this stage for a ballasted type installation, the buoyant portions are still only slightly buoyant.

Figure 14:
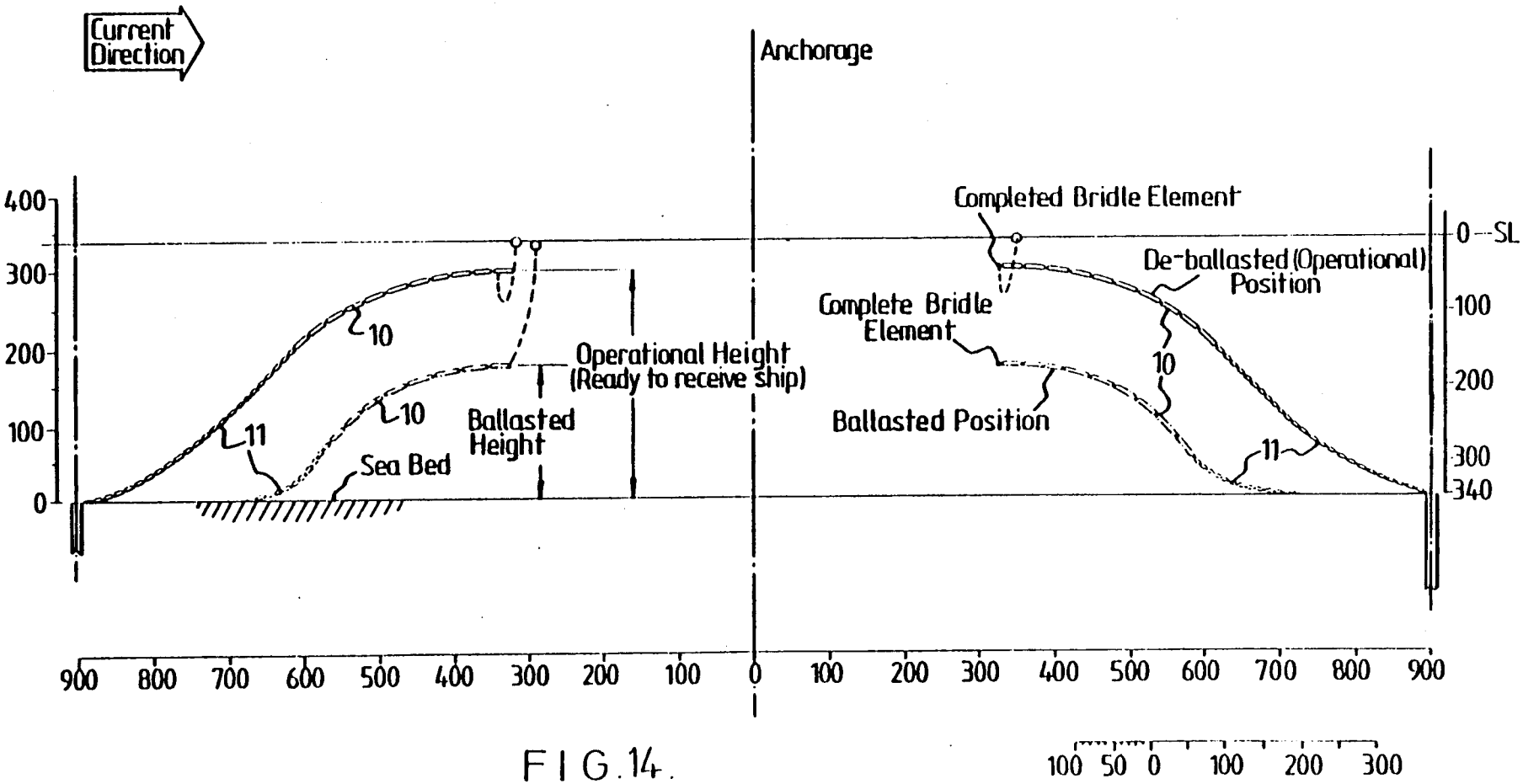

As illustrated in FIG. 14, the restraining members 18, 19 are finally removed. The system then sinks to a ballasted position (shown dotted in FIG. 14). The buoyant portions 10 are then de-ballasted which causes the system to rise into an operational position and to impart the operational preload into the system. The system is now ready to accommodate a vessel or structure.

There has been disclosed a mooring/support system which provides points for mooring or supporting near or preferably below the ocean surface. A mono-hull ship connected to the mooring/support system supplies its own ships lines which extend into a turret connection to enable the ship to rotate relative to the mooring/support system and thereby meet with the external environmental conditions imposed by waves, wind, and currents. The mooring/support system would of course be in place prior to the location of a ship over the selected sea bed location. However, the ship may also be utilised in the initial installation of the system. The system will allow different ships of different types to be moored individually at anyone time. It also could be used to support other structures while still being able to accommodate other ships at other times.

The mooring/support system provides mooring points which are near the surface of the sea in order to minimize the magnitude of vertical forces imposed upon the ship. This maintains the ship's lines in as nearly a horizontal position as possible. Where the mooring points are below the ocean surface, the depth of submergence would be such that attending vessels could pass over the mooring/support system without fouling it, but access to these mooring points would be effected by providing pendant lines connected to the mooring-/support points at one end and to a pendant buoy at the other. The pendant lines being of adequate length so the pendant floats on the surface to facilitate retrieval. The pendant lines could be used as an extension of the ship's lines. The pendant lines would also be used to pull on the mooring/support points to effect installation, or afterwards to facilitate inspection or maintenance.

Advantageously, the mooring/support system according to the present invention reduces induced vertical loading in the moored ship or supported tower that would otherwise be inherent in inclinded anchors or guy lines, resulting in a reduction in size and weight of some of the component parts of an anchoring or supporting system and also provides a substantial saving in costs for a total operational system. More specifically since the induced restraining force's horizontal components are not accompanied by large vertical components the net tension force in the ships lines are less than with a conventional anchoring system thereby allowing the use of physically smaller lines. Furthermore, since the major components of the mooring/support system are independent of the ship being moored or the structure being supported, less equipment, less storage space and less complexity are required on the ship making a substantial saving in the costs of producing such ships or structures.

Additional savings may be realized by pre-installing the mooring/support system so that it can be utilized as an anchorage for other vessels or marine structures such as drilling rigs, and constructions barges thus eliminating a need to provide them with their own temporary moorings.

Conveniently, the larger sized elements of the mooring/support system are located below the surface of the sea where the wave imposed drag and inertia forces would be less severe than at the surface resulting in a general reduction of the secondary forces applied to the mooring/support system and ship. Consequently the loadings induced from the mooring/support system upon the moored ship or supported structure are greatly reduced.

Conveniently the use of the mooring/support system according to the present invention provides a simpler and less expensive facility than any offshore drilling or production anchoring system presently known to applicant. It will also provide a less complex and more cost effective system for other applications.

The preloading of the mooring/support system can be made effective to load all the various components and connections continuously with a substantial force thereby eliminating backlash and excessive play. The preload can also preclude stress reversals and enhance the fatigue characteristic of the equipment used in the mooring/support system. The inclusion of a high preload force can result in a stress level within the anchor system that is higher than that which would be experienced in operation and, in effect, load tests and proves the capacity of the mooring/support system. The preload also minimizes the horizontal excursions of the moored ship or supported structure thereby providing greater accuracy in the positioning of the ship or structure during operation in all conditions.

If the system is damaged and broken the major components will float and can be easily recovered. Moreover, since the major part of the mooring/support system are at relatively shallow water depths they can be inspected, serviced and maintained easily.

Conveniently, the mooring/support system of the present invention is entirely passive and has no mechanically driven or operating parts, the natural force of buoyancy providing its load sustaining and special restraint capabilities.

Although the accuracy of positioning, utilising the mooring/support system of the present invention is greatly enhanced over the conventionally known systems even further position maintaining capability and accuracy can be achieved by incorporating a servo controlled tensioning system (commercially available) on the moored ship or supported structure.

Whilst the mooring/support system of the present invention has been particularly described with reference to oil and gas drilling and processing equipment the accurate positioning of surface equipment may be required for referencing of geographical position or to support objects at a specific location for other commercial or military reasons.

In another embodiment the mooring/support system can be utilised to provide support and maintain the position of large fish nets or pens in mid ocean for conducting fish farming operations. Moreover, the mooring/support system of the present invention can be utilised with any of the conventional marine structures hereinbefore referred to for accurately locating a surface supported or submerged structure, and can take the place of guy lines thereby greatly reducing the vertical downward loading imposed on the structure concerned.

Whilst the mooring/support system has been described herein with reference to anchor elements interconnected by a bridle element, it is possible to provide an anchoring system in accordance with the invention in which a minimum of two or three but any number of anchor elements can be provided and connected to a bridle element. For most mooring/support systems there would be provided several connecting points to a bridle element, most probably sufficient to define a circular pattern for the mooring/support points. The mooring/support points would be connected to radially extending anchor elements with each element comprising buoyant and non-buoyant portions, and being connected to a respective sea bed anchor. Where additional safety is necessary because of higher loading or because of torsional rigidity requirements the anchoring elements can be arranged to connect adjacent anchor elements in pairs to a common mooring/support point at the bridle element but to adjacent sea bed anchors.

In the buoyant portion of anchor element 1 the hollow steel chambers can be replaced by low density material filled floats or in an alternative construction the buoyant portion may comprise a series of hollow elongated steel structural elements connected end to end by a flexible coupling and sufficiently strong to sustain the loadings imposed on them during operation.

The buoyancy chambers may incorporate de-ballasting apparatus which will expel water intentionally placed in them. Such apparatus allows the mooring/support system to be installed at a minimum predetermined preload in the ballasted condition. Once the mooring/support system is installed the chambers are then deballasted thereby increasing the buoyancy forces in the buoyant portion of the element increasing the preload force $H_i$. In the case where the buoyant portion consists of buoyant floats connected to a chain or cable additional buoyant floats can be added after initial installation to increase the magnitude of the buoyant forces.

In an alternative construction the buoyant portion of the anchor line 1 comprises a plurality of hollow buoyancy elements having a central aperture. The buoyancy elements are mounted side by side on a cable thereby providing the necessary buoyancy and flexibility to the buoyant portion of the anchor element. The number of buoyancy elements can be increased after initial installation to increase the magnitude of the buoyant force in the buoyant portion.

Whilst the sea bed anchor disclosed herein is implanted into the sea bed, the anchor may comprise a large heavy object that could sustain the reactions from the mooring/support system by its weight and by the friction it develops with the sea bed. It may be desirable, in some instances, to design the lower end of the anchor element utilizing heavy or weighted chain to preclude uplift on the sea bed connection.

As the system is independent of the moored/supported objects and as it can be pre-installed it can provide additional advantages by serving as a mooring/support system for other associated vessels and marine equipment.

I claim:

1. A mooring/support system for anchoring a marine structure, comprising:

at least three anchor elements, each element having a given length, each anchor element including an elongated non-buoyant section having a first end for connection to a sea bed and a second end, and an elongated buoyant section for floating above said sea bed, said buoyant section having a first end connected to said second end of said non-buoyant section and a second end for disposition remote from said sea bed and near a surface of a sea covering said sea bed, each said second end defining a respective mooring point; and a bridle element containing a plurality of bridle segments for circumferentially linking each of said second ends of said buoyant sections together via respective bridle segments so as to form a substantially polygonal configuration, said anchor elements and said bridle element cooperating to ensure that when said mooring/support system is anchored to said sea bed at said first ends of said non-buoyant sections and said buoyant sections are located above said sea bed but below and near said surface of said sea, a pre-loading force is exerted on said anchor elements, said mooring points are maintained at a distance below said surface of said sea and said mooring/support system is maintained in position independently of said marine structure, and said mooring points provide respective spaced apart sites for the attachment of mooring lines to said marine structure.

2. A mooring/support system according to claim 1, wherein said non-buoyant portion of each anchor element is connected to the sea bed by a respective anchor.

3. A mooring/support system according to claim 1, wherein eight equiangularly spaced anchor elements are provided thereby giving said bridle element a substantially octagonal diametrical shape.

4. A mooring/support system according to claim 1, wherein when said mooring system is operationally disposed in said sea, each said buoyant portion adopts substantially the shape of one half of an inverted catenary, and each said non-buoyant portion adopts substantially the shape of one half of a normal catenary.

5. A mooring/support system according to claim 1, further comprising means for varying the buoyancy of each of said buoyant portions.

6. A mooring/support system according to claim 5, wherein for each of said anchor elements, said buoyant section is formed from hollow chambers and said means for varying the buoyancy comprises apparatus for admitting or expelling sea water from said hollow chambers.

7. A mooring/support system according to claim 6, further comprising means for controlling said means for varying the buoyancy so that for each of said anchor elements, said buoyancy of said buoyant portion can be maintained at a relatively low level during installation of said mooring/support system and said preloading of said bridle element can be effected by increasing said buoyancy of each of said anchor elements after attachment of said bridle element to said second ends of said buoyant portions.

* * * * *